US008875528B2

(12) United States Patent
Immink et al.

(10) Patent No.: US 8,875,528 B2
(45) Date of Patent: Nov. 4, 2014

(54) TEST CHAMBER WITH TEMPERATURE AND HUMIDITY CONTROL

(75) Inventors: Darin E. Immink, Holland, MI (US); Clinton A. Peterson, Holland, MI (US); Andrew R. Veldt, Saugatuck, MI (US)

(73) Assignee: Venturedyne, Ltd., Pewaukee, WI (US)

( * ) Notice: Subject to any disclaimer, the term of this patent is extended or adjusted under 35 U.S.C. 154(b) by 855 days.

(21) Appl. No.: 11/957,111

(22) Filed: Dec. 14, 2007

(65) Prior Publication Data

US 2009/0151370 A1 Jun. 18, 2009

(51) Int. Cl.

| | |
|---|---|
| ***F25D 9/00*** | (2006.01) |
| ***F25D 21/00*** | (2006.01) |
| ***F24F 3/14*** | (2006.01) |
| ***F25B 41/04*** | (2006.01) |

(52) U.S. Cl.

CPC ..... *F25B 41/04* (2013.01); *F25B 2600/2501* (2013.01); *F24F 3/1405* (2013.01); *F25B 2400/0403* (2013.01)

USPC ..... 62/150; 236/12.1

(58) Field of Classification Search

CPC F24F 3/1405; F25B 41/04; F25B 2400/0403; F25B 2600/2501; F25D 21/004; F25D 21/065; F28F 17/00

USPC ..... 62/196.6, 197, 150, 196.4; 236/12.1; 165/254; 73/865.6

See application file for complete search history.

(56) References Cited

U.S. PATENT DOCUMENTS

| | | | | |
|---|---|---|---|---|
| 3,734,810 | A * | 5/1973 | Davis | 165/240 |
| 3,933,004 | A * | 1/1976 | Carter et al. | 62/199 |
| 4,550,574 | A * | 11/1985 | Hohman | 62/197 |

(Continued)

FOREIGN PATENT DOCUMENTS

| | | |
|---|---|---|
| CN | 1699855 | 11/2005 |

OTHER PUBLICATIONS

International Search Report and Written Opinion for corresponding International Application No. PCT/US2008/86633 mailed on Feb. 4, 2009.

(Continued)

*Primary Examiner* — Marc Norman
*Assistant Examiner* — Paolo Gonzalez
(74) *Attorney, Agent, or Firm* — Michael Best & Friedrich LLP

(57) ABSTRACT

A test chamber that is capable of operating in a mode where the temperature of the chamber is efficiently cooled without removing a substantial amount of moisture from the air. In one aspect, the test chamber includes a structure defining a work space having air, and a temperature control system (e.g., a refrigeration system having a compressor, a condenser, and an evaporator valve). The temperature control system includes a heat exchanger (e.g., an evaporator) positioned to communicate with the air in the work space, a source of cold fluid (e.g., a compressed, condensed, and throttled refrigerant) coupled to the heat exchanger, a source of hot fluid (e.g., compressed refrigerant gas) coupled to the heat exchanger, and a controller for controlling a mixture of cold fluid and hot fluid entering the heat exchanger (e.g., by adjusting a cold fluid valve and/or a hot fluid valve). In order to limit the loss of humidity caused by condensation on the heat exchanger, it is preferred that the controller is programmed such that the temperature of the mixture entering the heat exchanger is controlled to limit a temperature differential between the heat exchanger and the air in the work space.

15 Claims, 3 Drawing Sheets

(56) References Cited

U.S. PATENT DOCUMENTS

| | | | | |
|---|---|---|---|---|
| 4,802,338 | A * | 2/1989 | Oswalt et al. | 62/98 |
| 5,088,295 | A * | 2/1992 | Shapiro-Baruch | 62/196.4 |
| 5,131,238 | A | 7/1992 | Meckler | |
| 5,168,715 | A * | 12/1992 | Nakao et al. | 62/181 |
| 5,181,387 | A | 1/1993 | Meckler | |
| 5,509,272 | A | 4/1996 | Hyde | |
| 5,651,258 | A | 7/1997 | Harris | |
| 5,664,425 | A | 9/1997 | Hyde | |
| 5,946,925 | A * | 9/1999 | Williams et al. | 62/196.4 |
| 6,023,985 | A * | 2/2000 | Fournier | 73/865.6 |
| 6,123,147 | A | 9/2000 | Pittman | |
| 6,189,329 | B1 * | 2/2001 | Peterson | 62/335 |
| 6,205,803 | B1 * | 3/2001 | Scaringe | 62/259.2 |
| 6,269,650 | B1 | 8/2001 | Shaw | |
| 6,374,621 | B1 * | 4/2002 | Berchtold | 62/114 |
| 6,499,307 | B1 * | 12/2002 | Peterson et al. | 62/196.1 |
| 6,536,518 | B2 * | 3/2003 | Trieskey | 165/240 |
| 6,595,012 | B2 | 7/2003 | Rafalovich | |
| 6,672,087 | B1 | 1/2004 | Taras et al. | |
| 6,679,128 | B2 * | 1/2004 | Wanek et al. | 73/865.6 |
| 7,048,435 | B2 * | 5/2006 | Shdaimah et al. | 374/14 |
| 7,257,957 | B2 | 8/2007 | Lifson et al. | |
| 7,275,384 | B2 | 10/2007 | Taras et al. | |
| 7,287,394 | B2 | 10/2007 | Taras et al. | |
| 2003/0121337 | A1 * | 7/2003 | Wanek et al. | 73/865.6 |
| 2003/0172751 | A1 | 9/2003 | Frannhagen et al. | |
| 2004/0168451 | A1 * | 9/2004 | Bagley | 62/196.4 |
| 2007/0240872 | A1 | 10/2007 | Hayashi et al. | |

OTHER PUBLICATIONS

Office Action from the State Intellectual Property Office of the People's Republic of China for Application No. 200880122143.2 dated Mar. 15, 2012 (Translation and Original, 15 pages).

Sporlan Valve Company, Discharge Bypass Valves for System Capacity Control, Bulletin 90-40, Jan. 2004, pp. 1-4,6 pages total, Sporlan Valve Company, Washington, MO.

* cited by examiner

TEST CHAMBER WITH TEMPERATURE AND HUMIDITY CONTROL

BACKGROUND

The present invention relates to a temperature- and humidity-controlled test chamber and a method of controlling the temperature and humidity thereof.

General purpose environmental test chambers typically are designed for several tasks requiring distinct modes of operation. One such task may be high and low temperature transitions and stabilizations with the temperature ranging from 180° C. to −70° C. Typically, to reach lower temperatures with mechanical refrigeration, a cascade refrigeration system is used. This requires two separate refrigeration circuits (stages) with a high pressure refrigerant in the low stage and a relatively lower pressure refrigerant in the high stage to "cascade" the heat out of the chamber, lowering the air temperature in the enclosed space.

Another task may be the precise control of temperature and humidity within the cabinet workspace. When operating in the temperature/humidity mode, it is important to keep the cooling coil above the freezing point of water to prevent excessive moisture migration (i.e., ice formation on the coil) and blockage of air flow through the cooling coil. To account for this, some designs incorporate a separate cooling coil within the chamber workspace and utilize the high stage refrigerant to maintain a cooling coil temperature above the freezing point of water. The refrigerant is expanded from a liquid to a vapor at a controlled pressure. The evaporating pressure is set based on the lowest temperature required for the temperature/humidity mode of operation, but above the freezing point of water. When cooling is required at the highest temperature/humidity combination in the operational range, a portion of the cooling coil temperature is significantly below the dew point of the air stream within the chamber, resulting in condensation and a considerable cooling requirement due to the latent heat of condensation. Moisture condensed from the air must be replaced to maintain the controlled humidity condition. Steam may be added by a boiler (not shown) that is open to the chamber atmosphere, or by pressurized steam rails (not shown). Moisture may also be added to the chamber by way of an atomizing spraying system. The re-introduction of moisture is often accompanied by sensible heat (steam), further increasing the cooling load. Additional cooling causes additional condensation, which increases the amount of steam required to replace the condensed moisture. As a result, temperature and humidity must be continuously monitored and corrected to ensure they stay within the desired ranges.

There is also a need in the market to operate at high temperature/humidity conditions while a product(s) within the chamber generates heat. A product, or thermal load, within the chamber may fall into one of two categories: a thermal load that generates heat is called a "live load," and a thermal load that does not generate heat is called a "dead load." Maintaining high temperature/humidity conditions in a system containing a live load is a challenge. The current systems either limit the temperature/humidity range, limit the allowable amount of heat dissipation by the live load, or are specialized such that the overall utility of the equipment is compromised.

SUMMARY

The present invention provides a test chamber that is capable of operating in a mode where the temperature of the chamber is efficiently cooled without removing a substantial amount of moisture from the air. This is particularly desirable when both temperature and humidity control are important. In one aspect, the test chamber includes a structure defining a work space having air, and a temperature control system (e.g., a refrigeration system having a compressor, a condenser, and an evaporator valve). The temperature control system includes a heat exchanger (e.g., an evaporator) positioned to communicate with the air in the work space, a source of cold fluid (e.g., a compressed, condensed, and throttled refrigerant) coupled to the heat exchanger, a source of hot fluid (e.g., compressed refrigerant gas) coupled to the heat exchanger, and a controller for controlling a mixture of cold fluid and hot fluid entering the heat exchanger (e.g., by adjusting a cold fluid valve and/or a hot fluid valve). In order to limit the loss of humidity caused by condensation on the heat exchanger, it is preferred that the controller is programmed such that the temperature of the mixture entering the heat exchanger is controlled to limit a temperature differential between the heat exchanger and the air in the work space.

The present invention is also embodied in a method of controlling the temperature of a test chamber having a temperature control system including a source of cold fluid, a control valve that limits the flow of cold fluid, a source of hot fluid, and a heat exchanger. The method comprises positioning a heat exchanger in the chamber, flowing a cold fluid (e.g., a compressed, condensed, and throttled refrigerant) toward the heat exchanger, flowing a hot fluid (e.g., compressed refrigerant gas) toward the heat exchanger, mixing the cold fluid with the hot fluid to produce a mixture, and controlling the ratio of hot fluid and cold fluid in the mixture (e.g., adjusting a cold fluid valve and/or a hot fluid valve to control the amount of cold fluid mixing with the hot fluid to control the temperature of the mixture in the heat exchanger). In order to limit the loss of humidity caused by condensation on the heat exchanger, it is preferred that controlling includes adjusting the temperature of the mixture in the heat exchanger to control the temperature differential between the heat exchanger and the air in the work space.

Other aspects of the invention will become apparent by consideration of the detailed description and accompanying drawings.

DETAILED DESCRIPTION

Figure 1:
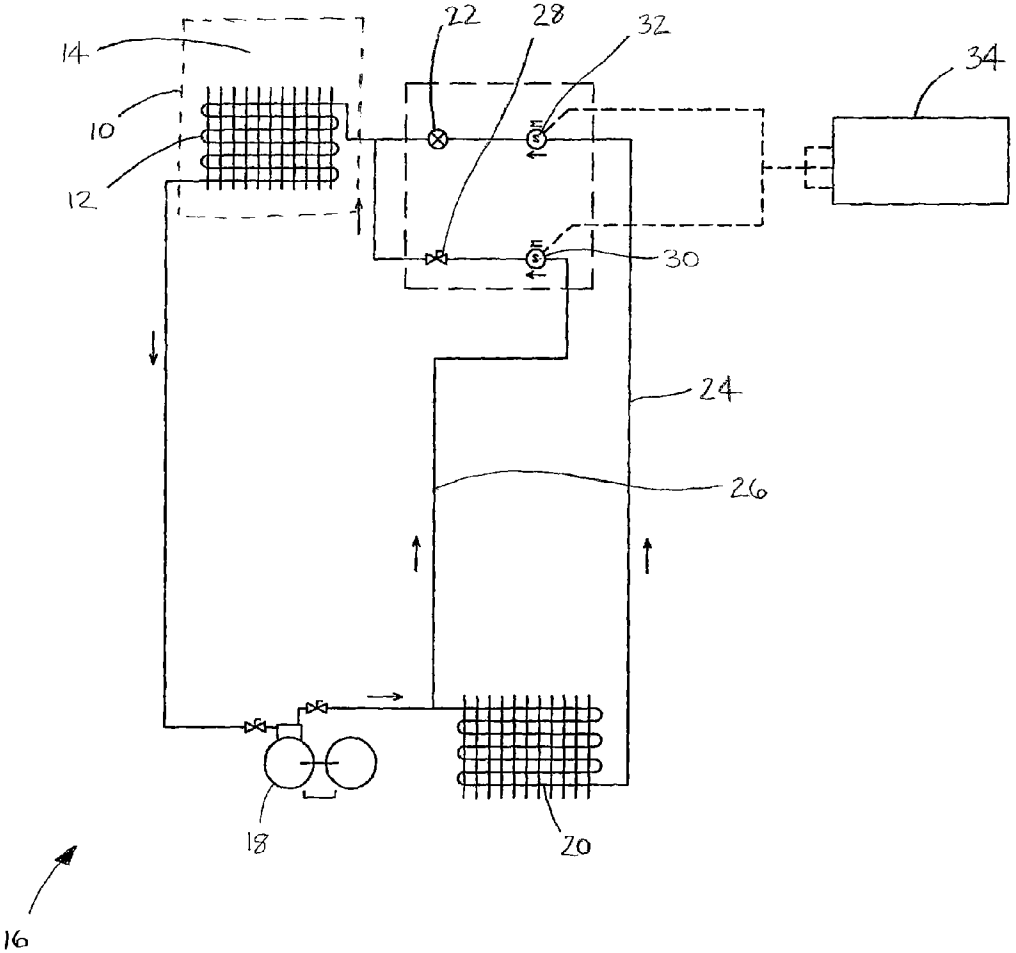
FIG. 1 is a schematic diagram of a first construction of the refrigeration apparatus in accordance with the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

This is an apparatus and method for controlling the temperature in a temperature/humidity test chamber 10 using a vapor refrigerant flowing through a closed loop system. The vapor refrigerant is circulated through a temperature-controlled coil 12 within an environmental test chamber load space 14. When cooling is required without a reduction in humidity, the vapor refrigerant is preconditioned to control (i.e., reduce substantially, while still achieving the desired cooling result) the temperature differential between the coil 12 and a moisture-laden air stream passing across the coil 12, thereby reducing or eliminating the amount of moisture from the air stream that condenses on the coil 12. Since less moisture is lost in the cooling process, the need to replace moisture by adding steam to the test chamber load space 14 is reduced. Because less sensible heat from steam is added and there is less latent heat transferred from condensation, the efficiency of the system is improved and the system is capable of accommodating test loads that dissipate more heat. When dehumidification is desired, the temperature-controlled coil 12 can act as an evaporator in a manner well understood by those of ordinary skill in the art. That is, a portion of the evaporator may be controlled to fall below the dew-point of the chamber air such that chamber air passing over the evaporator condenses on the coil. If necessary, a heater(s) (not shown) in the test chamber reheats the dehumidified air.

In accordance with the present invention, the refrigerant entering the temperature-controlled coil 12 is a mixture of cold liquid or liquid/vapor refrigerant and hot vapor refrigerant having, in total, a greater mass flow rate than conventional evaporator coils. The increased flow rate allows heat transfer to occur between the coil 12 and the load space 14 at a lower temperature differential. Thus, the temperature-controlled coil 12 can provide efficient cooling to the load space 14 without removing moisture from the load space air. The present invention may be applied to any refrigeration circuit. Two possible constructions are described below.

In one construction, shown in FIG. 1, a single stage closed-loop refrigeration system 16 includes a single stage compressor 18, a condenser 20, an expansion valve 22, and a coil 12. The compressor 18 compresses a refrigerant gas, which is then condensed into a liquid refrigerant by the condenser 20, which could be an air-cooled, liquid-cooled or other suitable type of condenser. The liquid refrigerant travels to the expansion valve 22 by way of a liquid line 24. The refrigerant then travels to the coil 12, which is located in the environmental test chamber load space 14. The evaporating refrigerant removes heat from the load space 14 in a manner well understood by those of ordinary skill in the art.

In accordance with the present invention, a superheated vapor line 26 fluidly connects the compressor 18 to the coil 12, allowing superheated vapor to bypass the condenser 20 and mix with liquid or two-phase refrigerant from the liquid line 24 before entering the coil 12. A manually-operated valve 28 and a first control valve 30 are located on the superheated vapor line 26, and a second control valve 32 is located on the liquid line 24. The first and second control valves 30, 32 are controlled by a chamber controller 34 to regulate the mixture of superheated vapor and liquid or two-phase refrigerant that enters the coil 12. More appropriately, the coil 12 should be called a "temperature-controlled coil" in accordance with the present invention because the temperature of the refrigerant mixture entering the coil is controlled. It should be understood that the first and second control valves 30, 32 can be combined into a single three-way valve with an inlet from the superheated vapor line 26, an inlet from the liquid line 24, and an outlet to the coil 12.

The chamber controller 34 operates in two modes: temperature control and temperature/humidity control. In each mode, the flow of refrigerant through the first and second control valves 30, 32 is regulated to achieve a mixture of superheated vapor and liquid or two-phase refrigerant that is appropriate to maintain the load space 14 at a temperature and humidity set-point inputted by a user.

In temperature control mode, the refrigerant mixture is controlled to bring the temperature in the test chamber 10 to the set point without concern for humidity levels. In this mode, cooling is accomplished by cooling the coil 12 to a low temperature in order to achieve the desired temperature in the chamber quickly. In this mode, a portion of the coil 12 could be below the dew-point of the air in the test chamber 10, and thus could result in condensation and a reduction in the humidity of the air in the test chamber 10.

In temperature/humidity control mode, a temperature-controlled refrigerant mixture is introduced to the temperature-controlled coil 12. When high relative humidity and cooling are requested, it is undesirable and inefficient (for reasons explained above) to dehumidify the load space air. Accordingly, liquid refrigerant from the liquid line 24 is metered and mixed with a stream of vapor refrigerant from the superheated vapor line 26. This causes the temperature of the refrigerant entering the coil 12 to be higher than normal, and thus the $\Delta T$ between the coil 12 and the air in the chamber 10 is relatively small. The result is little, if any, condensation on the coil 12, and thus little, if any, loss of moisture in the air in the test chamber 10.

Figure 3:
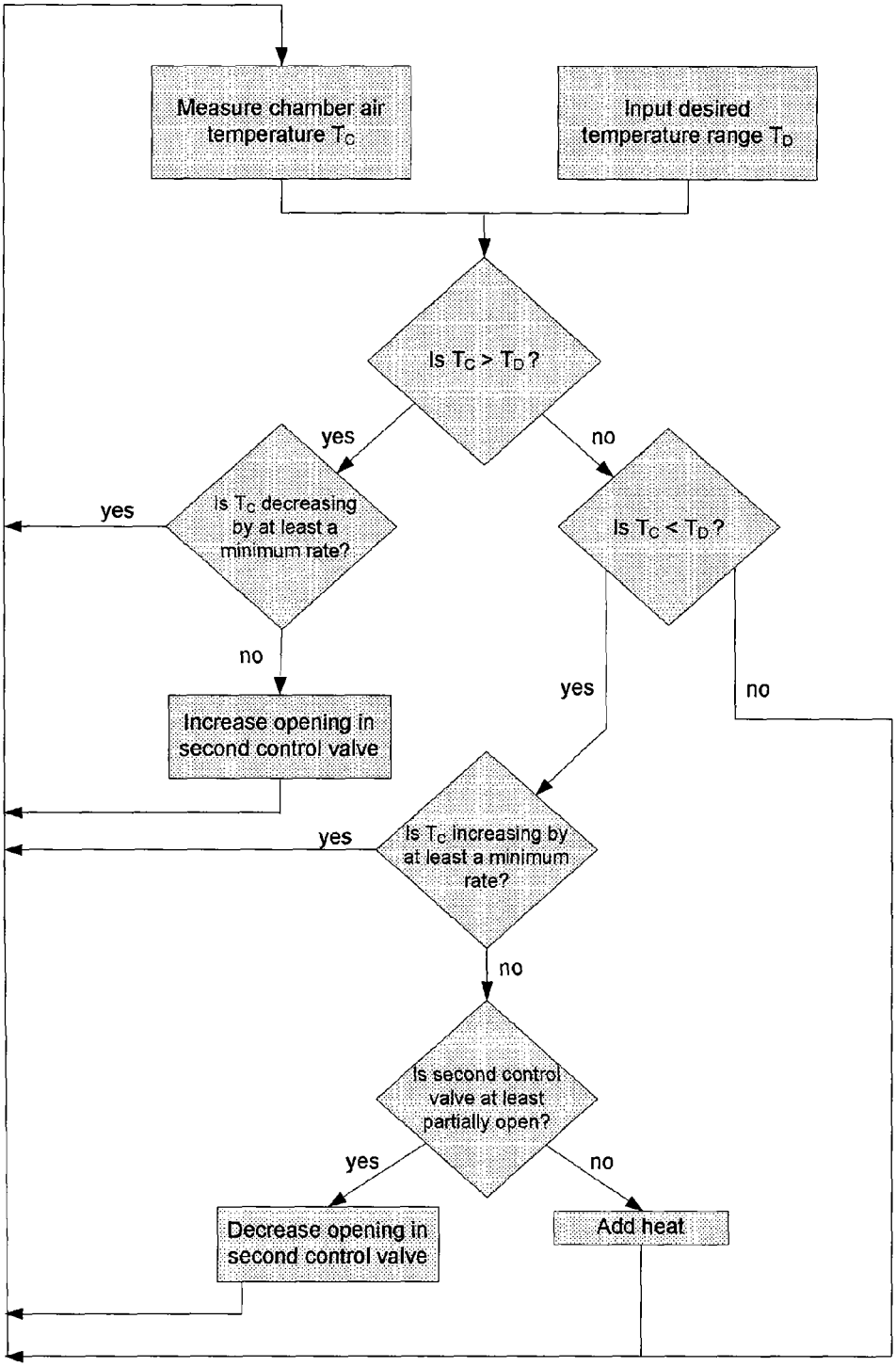
FIG. 3 is a flowchart illustrating one way of controlling the apparatus of FIG. 1.

FIG. 3 shows a flowchart illustrating the temperature-control portion of the temperature/humidity control mode. During this control process, the flow of superheated vapor through the superheated vapor line 26 is maintained constant, and thus all control of the refrigerant entering the coil 12 is accomplished by varying the amount of liquid refrigerant entering from the liquid line 24 by adjusting the second control valve 32. First, the temperature inside the chamber load space $T_C$ is measured and compared with a desired temperature range $T_D$, which can be input by the user. Typically, the user enters a specific desired temperature, and the controller provides a reasonable temperature range to maintain.

If $T_C$ is above $T_D$, then the chamber is in need of cooling, and the controller 34 opens the second control valve 32 slightly to increase the amount of liquid refrigerant that is mixed with vapor refrigerant from the superheated vapor line 26. This amount is initially set low to minimize the temperature difference between the load space air and the coil 12. If no decrease is seen in the load space air temperature, then the controller 34 further increases the mass flow rate of liquid refrigerant by further opening the second control valve 32. The valves may be pulse-width modulated to control the mass flow rate by pulsing the valve open and closed for calculated periods of time, as is known in the art. This process is continued until a decrease in $T_C$ is detected. As soon as a decrease in $T_C$ is detected, the process is held steady and monitored until $T_C$ is within $T_D$, or until $T_C$ is no longer moving toward $T_D$. When $T_C$ falls within $T_D$, monitoring of temperature continues as the live load in the test chamber 10 will continue to dissipate heat.

If $T_C$ is below $T_D$, then the chamber is in need of less cooling, and the controller 34 closes the second control valve 32 slightly to decrease the amount of liquid refrigerant that is mixed with vapor refrigerant from the superheated vapor line 26. If no increase is seen in the load space air temperature, then the controller 34 further decreases the mass flow rate of liquid refrigerant by further closing the second control valve 32. The valves may be pulse-width modulated to control the mass flow rate by pulsing the valve open and closed for calculated periods of time, as is known in the art. This process is continued until an increase in $T_C$ is detected. As soon as an increase in $T_C$ is detected, the process is held steady and monitored until $T_C$ is within $T_D$, or until $T_C$ is no longer moving toward $T_D$. If $T_C$ is no longer moving toward $T_D$ and the second valve is fully closed, then it may be necessary to add heat (e.g., by an auxiliary heat source) in order to increase $T_C$ to fall within $T_D$. When $T_C$ falls within $T_D$, monitoring of temperature continues.

When dehumidification is requested, the refrigerant mixture is controlled to be below the dew-point of the load space air. Typically, the amount of superheated vapor refrigerant is reduced via the first control valve 30 by either reducing the pulse rate or closing off the valve, and a liquid or two-phase refrigerant mixture may enter the temperature-controlled coil 12 via the second control valve 32 at a desired pulse rate. The mass flow rates of hot and cold refrigerant are controlled to achieve a mixture of a desired temperature. The temperature-controlled coil 12 may act as an evaporator in a manner well known to those of ordinary skill in the art, with at least a portion of the coil 12 cooling down to a temperature well below the dew-point of the load space air such that a portion of moisture in the load space air is condensed and removed from the system. This method will continue whenever dehumidification is desired. If heating of the air in the load space 14 is desired, separate heaters (not shown) in the chamber may be used to heat the air without adding moisture to the dehumidified air.

Figure 2:
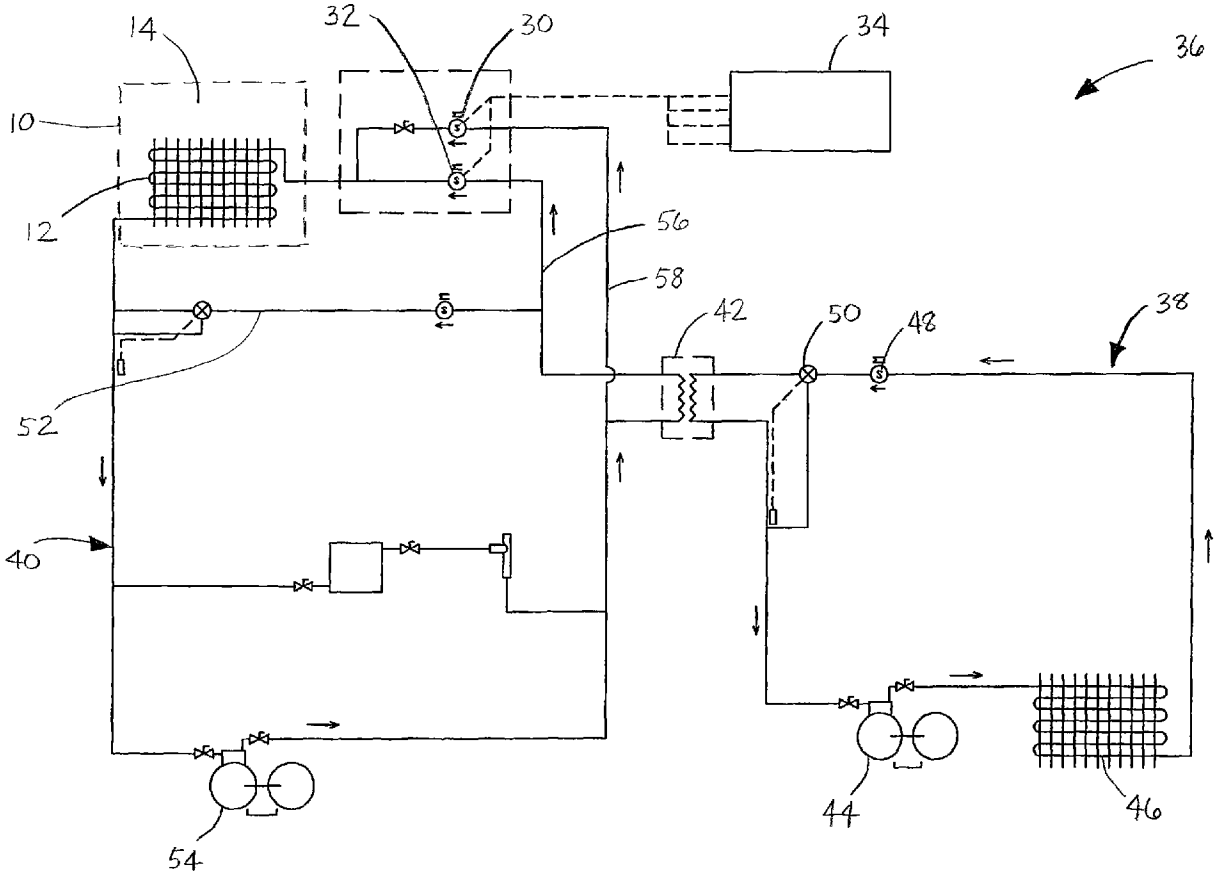
FIG. 2 is a schematic diagram of a second construction of the refrigeration apparatus in accordance with the present invention.

In another construction, shown in FIG. 2, a cascade refrigeration system 36 for low-temperature cooling includes a high stage refrigeration system 38 and a low stage refrigeration system 40. The high stage system 38 cools the low stage system 40 via a cascade heat exchanger 42.

The high stage refrigeration system 38, which operates in a manner well known to those of ordinary skill in the art, includes a high stage compressor 44, a high stage air-cooled or water-cooled condenser 46, a solenoid valve 48, and a cascade heat exchanger 42 in heat-transfer communication with the low stage refrigeration system 40. An expansion valve 50 is located at the inlet to the cascade heat exchanger 42.

The low stage refrigeration system 40 includes a low stage compressor 54 in fluid communication with the cascade heat exchanger 42 and a coil 12 located in a load space 14. A liquid line 56 fluidly connects the cascade heat exchanger 42 to the coil 12 and may also include an expansion valve or other expansion device (not shown). An injection line 52 carrying liquid refrigerant from the condenser 42 includes a solenoid valve and an expansion valve to selectively cool superheated vapor refrigerant returning to the compressor. Under some conditions, the superheated vapor leaving the coil 12 may cause the compressor 54 to overheat, thus the injection line cools the superheated vapor by selectively allowing some liquid refrigerant to expand. The cascade system operates in a manner well understood by those of ordinary skill in the art, except for the portion of the system that is the invention, as described below.

In accordance with the present invention, a superheated vapor line 58 fluidly connects the low stage compressor 54 to the coil 12 (which is more appropriately termed the "temperature-controlled coil" as explained above) and includes a first control valve 30. The liquid line includes a second control valve 32. The first and second control valves 30, 32 are controlled by a chamber controller 34 to regulate the mixture of superheated vapor and liquid or two-phase refrigerant that enters the temperature-controlled coil 12. The temperature-controlled coil 12 is located within a test chamber 10 and is in heat-transfer communication with the load space 14.

The chamber controller 34 of the second construction operates in two modes: temperature mode and temperature/humidity mode. In each mode, the flow of refrigerant through the first and second control valves 30, 32 is regulated to achieve a mixture of superheated vapor and liquid or two-phase refrigerant that is appropriate to maintain the load space 14 at a temperature or temperature/humidity set-point inputted by a user. The modes are the same as previously described in the first construction of the invention.

In previous designs of a cascade system for temperature/humidity control of test chambers, a high stage evaporator was located in the test chamber load space 14. In accordance with the present invention, the specialized high stage cooling circuit on the high stage refrigeration system 38 is removed from the chamber's temperature-transitioning environment 14. This removal of mass reduces the thermal load and improves temperature transition performance. The refrigerant circuiting and modes of operation are also simplified. Fewer circuit components are required, increasing reliability of the equipment and reducing costs. This design also improves efficiency and increases the heat dissipation capacity of the equipment at high relative humidity conditions without compromising other modes of operation.

In an alternate construction, instead of merging the liquid line with the superheated vapor line and controlling the mixture of refrigerant, a heat exchanger may provide heat transfer communication between the liquid and superheated vapor lines in order to provide a temperature-controlled refrigerant to the coil 12.

Thus, the invention provides, among other things, an apparatus and method for controlling the humidity and temperature of a live load test chamber. Various features and advantages of the invention are set forth in the following claims.

What is claimed is:

1. A test chamber comprising: a structure defining a work space having air; a refrigeration system comprising: a heat exchanger positioned to communicate with the air in the work space; a compressor coupled to the heat exchanger and producing a hot fluid; a condenser coupled to the compressor and producing a liquid; a throttle valve coupled to the condenser and producing a cold fluid; and a controller for controlling a mixture of cold fluid and hot fluid entering the heat exchanger, wherein the controller includes a temperature-humidity mode in which the controller is programmed to control a flow rate of cold fluid mixing with the hot fluid at a first flow rate, and programmed to determine a temperature of air in the test chamber, and if the temperature of air in the test chamber is greater than a desired temperature range, the controller is programmed to increase the flow rate of cold fluid mixing with the hot fluid by a slight increment, said slight increment being designed to control a temperature differential between the mixture and air in the work space in order to control condensation formation on the heat exchanger so as to limit loss of humidity in the air in the work space, to reach a second flow rate that is greater than the first flow rate, programmed to monitor the temperature of air in the test chamber, and programmed to determine whether the temperature of air in the test chamber has decreased, and if the temperature of air in the test chamber has not decreased, the controller is programmed to further increase the flow rate of cold fluid mixing with the hot fluid by a slight increment to reach a third flow rate that is greater than the second flow rate and programmed to continue monitoring the temperature of air in the test chamber, determining if the temperature of air in the test chamber has decreased, and continuing increasing the flow rate of the cold fluid mixing with the hot fluid by a slight increment if the temperature of air in the test chamber has not decreased until a decrease in temperature is achieved, thereby the controller is controlling a ratio of cold fluid and hot fluid in the mixture to control a temperature differential between the mixture and air in the work space in order to control condensation formation on the heat exchanger.

2. The test chamber as claimed in claim 1, wherein the controller is programmed such that the temperature differential between the mixture and the air in the work space is controlled.

3. The test chamber as claimed in claim 1, wherein the refrigeration system further comprises a cold fluid valve that limits an amount of cold fluid entering the heat exchanger, wherein the controller adjusts the cold fluid valve to control the amount of cold fluid mixing with the hot fluid to control a temperature of the mixture entering the heat exchanger.

4. The test chamber as claimed in claim 3, wherein the controller includes the temperature-humidity mode that is programmed to limit a drop in the temperature of the mixture to thereby limit a temperature differential between the mixture and the air in order to reduce condensation formation on the heat exchanger.

5. The test chamber as claimed in claim 4, wherein the controller further includes a dehumidification mode that is programmed to allow a greater drop in temperature of the mixture to thereby increase a temperature differential between the mixture and the air in order to increase condensation formation on the heat exchanger.

6. The test chamber as claimed in claim 1, wherein the heat exchanger is an evaporator.

7. The test chamber as claimed in claim 6, wherein the cold fluid is a refrigerant.

8. The test chamber as claimed in claim 6, wherein the refrigeration system further comprises a hot fluid line connecting an output of the compressor with an input of the evaporator.

9. The test chamber as claimed in claim 8, wherein the refrigeration system further comprises a hot fluid valve that limits an amount of hot fluid entering the evaporator, wherein the controller adjusts the hot fluid valve to control the amount of hot fluid mixing with the cold fluid exiting the throttle valve to control a temperature of the mixture entering the evaporator.

10. A method of controlling a temperature of air in a test chamber having a temperature control system including a source of cold fluid, a control valve that limits the flow of cold fluid, a source of hot fluid, and a heat exchanger, the method comprising: positioning the heat exchanger in communication with the chamber; flowing the cold fluid toward the heat exchanger at a first flow rate; flowing the hot fluid toward the heat exchanger; simultaneously directing the temperature of air in the test chamber towards a desired temperature range and maintaining a humidity of the air near a desired humidity range by controlling a flow rate of the cold fluid mixing with the hot fluid; mixing the cold fluid with the hot fluid to produce a mixture entering the heat exchanger; and determining the temperature of air in the test chamber and, if the temperature of air in the test chamber is greater than a desired temperature range, performing the following steps: increasing the flow rate of cold fluid mixing with the hot fluid by a slight increment, said slight increment being designed to control a temperature differential between the mixture and air in the chamber in order to control condensation formation on the heat exchanger so as to limit the loss of humidity in the air in the test chamber, to reach a second flow rate that is greater than the first flow rate; monitoring the temperature of air in the test chamber; determining whether the temperature of air in the test chamber has decreased; and if the temperature of air in the test chamber has not decreased, further increasing the flow rate of cold fluid mixing with the hot fluid by a slight increment to reach a third flow rate that is greater than the second flow rate and continuing monitoring the temperature of air in the test chamber, determining if the temperature of air in the test chamber has decreased, and continuing increasing the flow rate of cold fluid mixing with the hot fluid by a slight increment if the temperature of air in the test chamber has not decreased until a decrease in temperature is achieved, thereby controlling a ratio of hot fluid and cold fluid in the mixture to control the temperature differential between the mixture and air in the chamber in order to control condensation formation on the heat exchanger.

11. The method as claimed in claim 10, wherein the test chamber further includes a cold fluid valve, and wherein increasing the flow rate of cold fluid by a slight increment includes adjusting the cold fluid valve to control an amount of cold fluid mixing with the hot fluid to control a temperature of the mixture entering the heat exchanger.

12. The method as claimed in claim 10, wherein flowing a cold fluid comprises:

compressing a refrigerant into a superheated vapor;

condensing the superheated vapor into saturated or subcooled liquid; and throttling the liquid, wherein the liquid is the cold fluid.

13. The method as claimed in claim 12, wherein flowing a hot fluid comprises diverting a portion of the superheated vapor toward the heat exchanger, wherein the superheated vapor is the hot fluid.

14. has been amended to read: The method as claimed in claim 13, wherein the test chamber includes a hot fluid valve, and wherein controlling includes adjusting the hot fluid valve to control an amount of hot fluid mixing with the cold fluid to control a temperature of the mixture entering the heat exchanger.

15. A method of controlling a temperature of air in a test chamber having a temperature control system including a source of cold fluid, a source of hot fluid, and a heat exchanger, the method comprising: positioning the heat exchanger in communication with the chamber; flowing the cold fluid toward the heat exchanger; flowing the hot fluid toward the heat exchanger; mixing the cold fluid with the hot fluid to produce a mixture having a ratio of cold fluid to hot fluid; simultaneously directing the temperature of air in the test chamber towards a desired temperature range and maintaining a humidity of the air near a desired humidity range by controlling the ratio; and determining the temperature of air in the test chamber and, if the temperature of air in the test chamber is greater than a desired temperature range, performing the following steps: increasing the ratio by a slight increment, said slight increment being designed to control a temperature differential between the mixture and air in the chamber in order to control condensation formation on the heat exchanger so as to limit the loss of humidity in the air in the test chamber; monitoring the temperature of air in the test chamber; determining whether the temperature of air in the test chamber has decreased; and if the temperature of air in the test chamber has not decreased, further increasing the ratio by a slight increment and continuing monitoring the temperature of air in the test chamber, determining if the temperature of air in the test chamber has decreased, and increasing the ratio by a slight increment if the temperature of air in the test chamber has not decreased until a decrease in temperature is achieved, thereby controlling the ratio to control the temperature differential between the mixture and air in the chamber in order to control condensation formation on the heat exchanger.

* * * * *

UNITED STATES PATENT AND TRADEMARK OFFICE

CERTIFICATE OF CORRECTION

PATENT NO. : 8,875,528 B2
APPLICATION NO. : 11/957111
DATED : November 4, 2014
INVENTOR(S) : Immink et al.

It is certified that error appears in the above-identified patent and that said Letters Patent is hereby corrected as shown below:

In the Claims

Claim 14, Col. 8, Line 38: delete the words “has” to “read:”

Signed and Sealed this
Seventeenth Day of February, 2015

Michelle K. Lee

Michelle K. Lee
*Deputy Director of the United States Patent and Trademark Office*